United States Patent [19]

Crase et al.

[11] 4,295,535

[45] Oct. 20, 1981

[54] IN-HOLE MOTOR DRILL WITH LOCKING BIT CLUTCH

[75] Inventors: Gary M. Crase, Cypress; Kurt M. Trzeciak, Irvine, both of Calif.

[73] Assignee: Smith International, Inc., Newport Beach, Calif.

[21] Appl. No.: 68,212

[22] Filed: Aug. 20, 1979

[51] Int. Cl.[3] ..... E21B 3/12

[52] U.S. Cl. ..... 175/101; 175/107

[58] Field of Search ..... 175/101, 106, 107; 415/502

[56] References Cited

U.S. PATENT DOCUMENTS 1,727,276 9/1929 Diehl ..... 175/101

2,167,019 7/1939 Yost ..... 175/107 X

FOREIGN PATENT DOCUMENTS 473792 9/1975 U.S.S.R. ..... 175/107

*Primary Examiner*—James A. Leppink

*Attorney, Agent, or Firm*—Philip Subkow; Bernard Kriegel; Newton H. Lee, Jr.

[57] ABSTRACT

An in-hole motor drill assembly has the rotor of the motor connected to the drill bit and a housing connected to the running string, and normally disengaged torque transmitting members between said housing and said drill bit provide for engaging said bit and running string for mutual rotation, by pulling on the running string. The torque transmitting members are locked in engagement, enabling the tension on the drill pipe string to be relieved, and the bit can be rotated by rotation of the drill pipe string in either direction. The usual pick-up bearing between the housing and the shaft provides an abutment for a releasable thrust transmitting member which normally holds the clutch disengaged.

16 Claims, 10 Drawing Figures

IN-HOLE MOTOR DRILL WITH LOCKING BIT CLUTCH

THE PRIOR ART

The prior art is Russian Pat. No. 395,557 granted Nov. 22, 1973, and the application of Trzeciak, Ser. No. 957,179, filed Nov. 2, 1978 now U.S. Pat. No. 4,232,751 and owned by the assignee of the present application.

In the Russian structure a spindle is rotatable in a drill pipe string and has a bit at its lower end. A fluid motor seats in the pipe and has its drive shaft engaged in the spindle to drive the bit. When the drill string is picked up, the motor is disengaged from the spindle and a clutch is engaged between the drill string and the spindle.

In the Trzeciak structure a bit sub has a torque transmitting connection with the drive shaft of an in-hole motor and thrust is transferred from the motor to the bit sub through a member which allows engagement of a clutch between the motor stator and the bit sub, when sufficient thrust load is applied downwardly on the bit. Thereafter, the bit can be rotated and pulled upon by the pipe string containing the motor.

BACKGROUND OF THE INVENTION

In the drilling of bore holes into or through earth formation, such as in the drilling of oil or gas wells, utilizing a rotary drill bit, it may occur, from time to time, that the bit may be stuck in the earth formation or debris in the bore hole, for example, either due to the caving in of the bore hole wall, or due to the formation of a key seat in the hard earth formation. When the bit is stuck, under such circumstances, it is difficult, if not impossible, to pull the drill string and bit from the bore hole. In the case of drilling by the usual rotary method, wherein the drill bit is attached to the lower end of a rotary string of drill pipe, it is an easy matter to rotate the drill pipe by the usual rotary table as an upward pull is being applied to the drill pipe, to assist in the release of the stuck bit.

In the case of in-hole motor drill assemblies of the electrical or fluid motor types wherein the rotary drill bit is driven by the in-hole motor interposed between the running string and the bit, there is no positive interlock between the rotor and the drill string, so that it is not possible to cause the bit to rotate by rotation of the running or drill pipe string or fluid conduit above the motor. The reaction torque of such in-hole motors is, generally, taken by a rotary table at the surface of the bore hole, whereby the drill pipe string can either be held stationary or, if desired, rotated to obviate the wedging of the string. If the bit becomes stuck in the bore hole, such in-hole motors will stall and continued rotation of the bit may not be possible, notwithstanding the availability of additional drilling fluid pressure or electromotive force. When such motor drills are stalled in the bore hole, rotation of the running pipe string by the rotary table is ineffective to cause bit rotation, since there is no positive rotary drive between the stator and the rotor and the bit remains wedged, or stuck, in the hole. As a consequence, when an in-hole motor drill has the drill bit stuck in the bore hole, an attempt can be made to pull the running pipe string and the motor drill from the bore hole, without rotating the bit, and various jarring devices have been utilized in the drill pipe string to assist in applying upward jarring forces to the drill pipe string and to the bit, in an effort to dislodge the latter.

In the event that the bit remains stuck, the practice has been to break the drill pipe joint above the motor drill assembly, if possible, in a known manner, whereby the drill pipe string can be retrieved to the drilling rig and, thereafter, to sidetrack the bore hole around the motor and bit which remain in the hole. Such practices result in great losses in time and costs.

Pending application Ser. No. 957,179, filed Nov. 2, 1978, by Trzeciak, relates to an in-hole motor drill apparatus, wherein the rotor of the motor is connected to the drill bit by a rotary drive connection through a clutch between the running string and the bit, including torque transmitting members, which can enable the stator or housing of the motor, in the event that the bit becomes stuck in the hole, to positively transmit torque to the bit, in response to rotation of the drill pipe string.

In a specific form the torque transmitting members interlock to enable the application of pulling force to the bit as it is rotated by the pipe string in one direction.

More particularly, a normally disengaged rotary clutch is provided between the motor housing and the bit and is engaged when weight is applied through the motor housing, by the drill pipe string, in excess of that normally applied during the drilling of the bore hole. In this connection, it will be understood that the progression of the bore hole, as the bit rotates, during normal drilling operations, is dependent upon the thrust or weight of the drill string applied to the cutting elements of the bit through the motor housing, such weight being transmitted to the in-hole motor drive shaft through a bearing which supports the drive shaft within the motor housing for rotation.

However, if the bit is stuck in soft formation, the application of additional weight may interfere with efforts to release the bit because the bit is forced deeper into the formation in which it is stuck.

In the companion application by Bela Geczy, Ser. No. 067,882, now U.S. Pat. No. 4,253,532, there is disclosed a bit clutch which can be engaged, if the bit is stuck, by applying an upward pull to the running pipe string, to engage the clutch by overcoming the resistance of strong springs which require the application of a pull on the pipe string on the order of, say, 100,000 pounds. The construction is one which requires that the pull be maintained during rotation of the bit, by rotation of the running pipe string.

Furthermore, the bearing assemblies of in-hole motors have a pick-up or off bottom bearing which transmits upward thrust to the shaft when the housing is elevated to pull the assembly from the bore hole or allow circulation of fluid while the bit is off bottom. Such pick-up bearings normally limit the permissible longitudinal upward movement of the housing relative to the shaft, and, therefore, engagement of the clutch responsive to additional upward movement of the housing requires a predetermined relationship in the structure of the pick-up bearing and the clutch to allow the additional movement required to engage the clutch.

SUMMARY OF THE INVENTION

The present invention (See also copending application Ser. No. 67,924.) relates to improvements in bit clutches for in-hole motor drill apparatus which has certain of the advantages disclosed in the above-identified applications, as well as other and further advantages.

More particularly, the present invention provides a bit clutch device which can be engaged without increasing the weight applied to the bit. Specifically, the bit clutch of the present invention is engaged by applying an upward strain or pull to the drill pipe and housing of the drilling structure.

Such an arrangement is advantageous because it becomes desireable, in normal drilling practice, to be able to lift the bit off bottom of the hole while drilling fluid continues to flow through the motor causing rotation of the bit. Any longitudinal upward motion of the housing relative to the shaft which can occur when the bit is picked up off bottom must not normally cause the clutch to be engaged, since when the clutch is engaged the motor can not turn the shaft. However, provision is made that when the bit is stuck, the necessary longitudinal upward movement of the housing relative to the shaft, to engage the clutch, can occur, when a shearable spacer is sheared by additional pull on the pipe string to permit the additional displacement for engagement of the clutch.

The bit clutch has a novel relationship to the pick-up or off bottom bearing which allows the pick-up bearing to be of normal construction, since upward thrust is transmitted to the pick-up bearing from the housing through a load transmitting member which is releasable. The releasable thrust member, under high load, in excess of that required during normal retrieval of the assembly or during off bottom circulation, allows telescopic movement of the housing relative to the shaft to engage the clutch, without requiring that the added motion be accommodated by the pick-up bearing.

Following the application of the necessary pull, say, 100,000 pounds, to engage the bit clutch of the present invention, the bit clutch is locked in engagement. As a result, the pulling force required to engage the clutch can be released or slacked off to the extent desired, before rotating the pipe string to rotate the bit, in an effort to release the stuck bit. Rotation can be accomplished in either direction. In addition, some weight can be applied to the bit during rotation if the application of some weight is desired. If desired, fluid can be circulated through the stalled motor to assist in working the bit free.

Accordingly, when the clutch is engaged and locked, release of the stuck bit can be attempted utilizing ordinary rotary drilling procedures.

Following release of the bit, if possible, by the combination of manipulative steps including rotation, in either direction, while applying some upward force or allowing the application of some downward force, the apparatus can be recovered from the bore hole for service.

In the present construction, the drive shaft and the housing of the bearing assembly for the in-hole motor are held relatively telescopically extended by the thrust member referred to above, which specifically has a frangible or shearable portion, so that, in all drilling operations, weight can be applied to the bit through the drilling or thrust bearings engaged between the housing and the shaft, and under normal circumstances the assembly can be retrieved or lifted off bottom for circulation of drilling fluid to flush the bore hole, by the usual off bottom or pick up bearing of the bearing assembly.

In our invention, the shearable portion of the thrust sleeve is adapted to be sheared if the bit is stuck, and if an upward pull on the bearing housing is applied which is in excess of the shear value of the shearable portion of the thrust sleeve. Thrust from the thrust sleeve is applied to a spring seat of a spring loaded pick-up bearing and the seat engages a stop to prevent compressive overload of the pick-up bearing. Upon shearing of the shearable portion of the thrust sleeve, the torque transmitting elements or clutch members carried by the housing and by the shaft are allowed to move into engagement and are locked in engagement, to permit the above-described rotation of the shaft or bit in response to rotation of the running pipe and the bearing housing, and such rotation is not dependent upon the maintenance of the tension forces employed to shear the shear portion of the thrust sleeve. Thus, some weight can be applied downwardly or some upward pull can be applied during rotation of the bit.

Certain bearing assemblies for in-hole motors are lubricated by the flow of a certain portion of the drilling fluid through the space between the shaft and the housing in which the bearings are located, and the present invention is shown in such a bearing assembly. However, since the clutch structure of the present invention is responsive to pull applied to the pipe to elevate the bearing housing relative to the shaft, the clutch components can also be incorporated in a sealed or lubricated bearing housing, such as that shown, for example, in the pending application of Geczy and Tschirky, Ser. No. 818,423, filed July 25, 1977 for Sealed Bearing Means For In-Hole Motors.

An object of the invention then is to provide a motor assembly including the bearing structure and bit clutch which is adapted to be connected to a string of running pipe, at one end of the assembly, and to receive a bit at the other end of the assembly, and operable, when in use and needed, to connect the drive shaft to the housing for mutual rotation of the running string and the bit and to lock them in engagement.

When the clutch is engaged, the fluid motor cannot drive the bit, but continued circulation of fluid is desirable or necessary to flush the bore hole. Accordingly, in the use of the apparatus, a valve is preferably installed in the pipe string above the motor to enable the fluid to bypass the motor from the pipe into the annulus. Such valves are exemplified in Tschirky et al, U.S. Pat. No. 3,989,114 and in application, Ser. No. 047,296 filed June 11, 1979 of Emery. The combination of such a circulation valve and a clutch is more particularly the subject of the pending application of Geczy Ser. No. 055,690.

As indicated above, certain well known jarring devices are generally installed in the pipe string above the motor to apply heavy blows to the pipe tending to release a stuck pipe or bit. Such jarring forces may apply an upward thrust to the pipe and the motor assembly sufficient to release the shearable thrust transmitting member which holds the clutch disengaged. Preferably, in use, the clutch is first engaged and, then, with the pipe string held in tension to apply an upward force on the bit through the engaged clutch, but without rotating the bit, the jar can be actuated to apply a large additional upward force to the bit tending to pull it free.

If the bit cannot be released, the pipe string can be torqued to the left, to a certain extent, and thereafter a so-called "string shot" can be employed in an effort to explosively release a pipe joint above the motor assembly, so that the pipe string above the motor can be retrieved.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Figure 1:
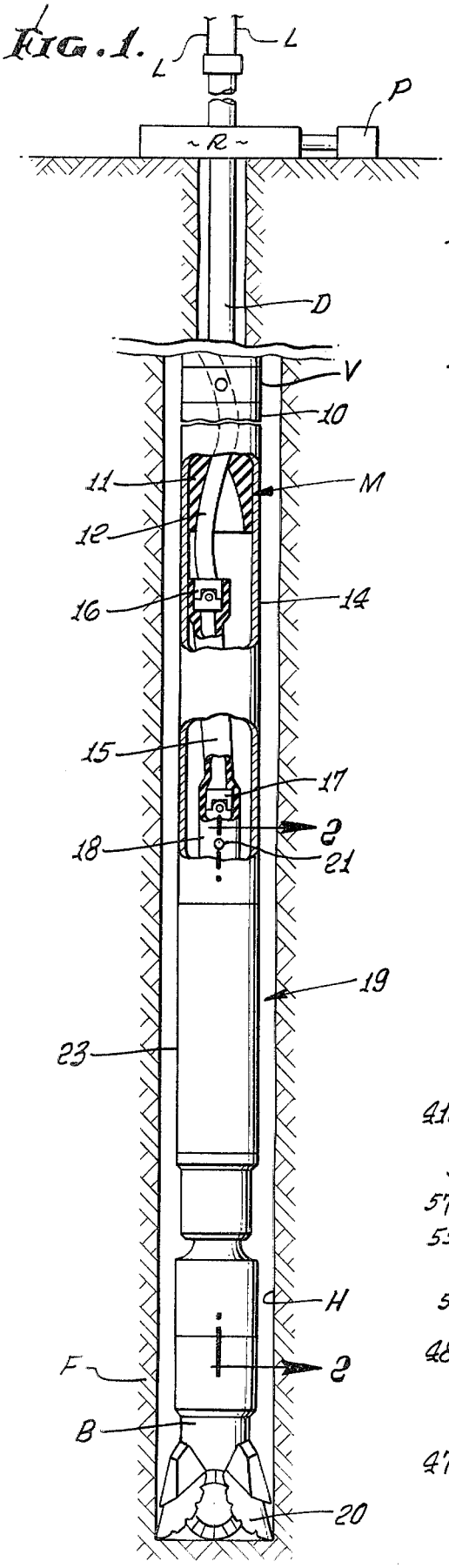
FIG. 1 is a view diagramatically showing an in-hole motor drill, partly in elevation and partly in section, in an earth bore hole, and incorporating clutch structure in accordance with the invention.

As seen in the drawings, referring first to FIG. 1, an in-hole motor assembly M is connected to the lower end of a string of drilling fluid conducting drill pipe D and has its housing 10 providing a progressing cavity stator 11 for a rotatable helicoidal rotor 12. The illustrative motor is a positive displacement-type fluid motor of a known type. The rotor is driven by the downward flow of fluid supplied to the pipe string from the usual pump P on a drilling rig having a rotary R which can rotate the pipe D suspended by the usual drilling lines L of a rig (not shown). A normally closed circulation valve V is in the pipe above the motor. The fluid passes downwarly through a connecting rod housing section 14 which contains a connecting rod assembly 15, connected by a universal joint 16 to the lower end of the rotor 12 and by a universal joint 17 to the upper end of the drive shaft 18. The drive shaft extends downwardly through a bearing assembly 19, and at its lower end, the drive shaft is connected to a drill bit B, having cutters 20 adapted to drill through the earth formation F, in the drilling of a bore hole H. The drive shaft 18 is tubular and has, adjacent its upper end, inlet ports 21, through which the drilling fluid passes from the connecting rod housing 14 into the elongated central bore 22 of the drive shaft, the fluid exiting from the bit B to flush cuttings from the bore hole and cool the bit.

Figure 2A:
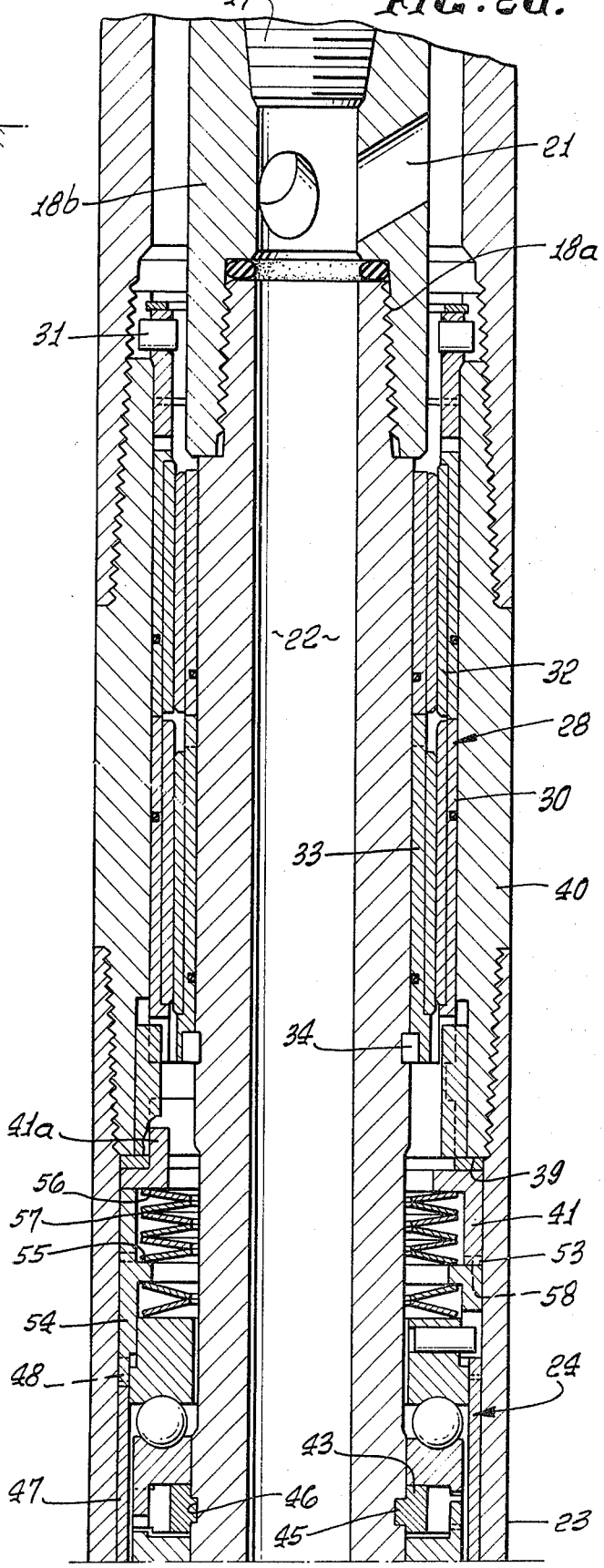
FIGS. 2*a*, 2*b* and 2*c*, together, constitute an enlarged longitudinal section, as taken on the line 2—2 of FIG. 1, showing the bit clutch construction in the bearing assembly, with the clutch disengaged.
Figure 2B:
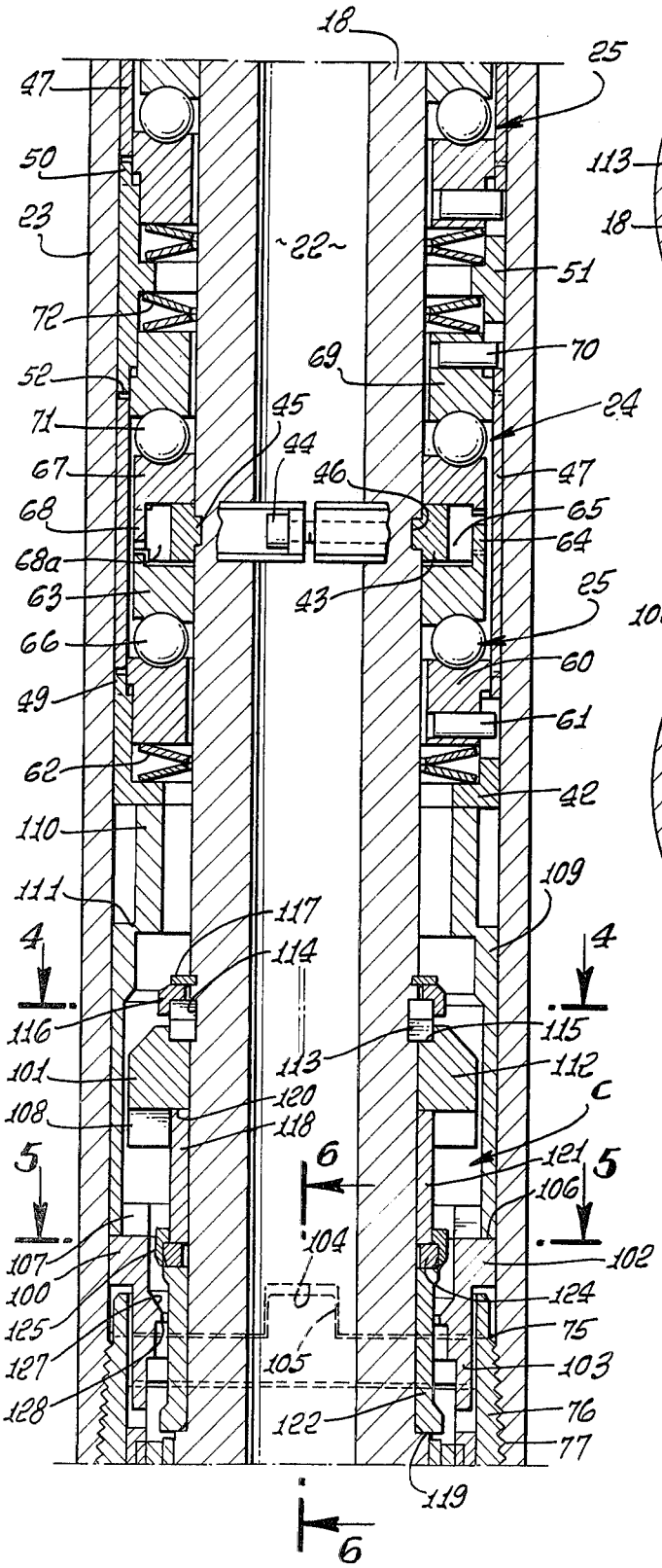
Figure 4:
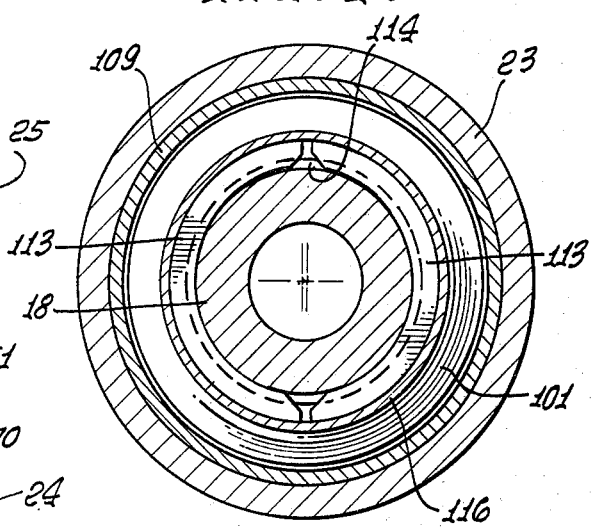
FIG. 4 is a transverse section, as taken on the line 4—4 of FIG. 2*b*.
Figure 5:
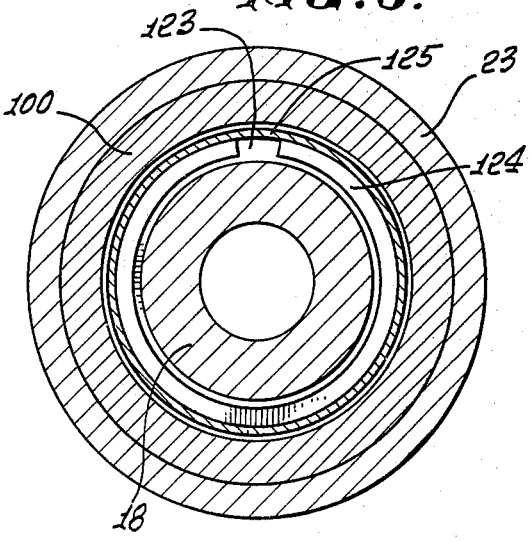
FIG. 5 is a transverse section as taken on the line 5—5 of FIG. 2*b*.
Figure 2C:
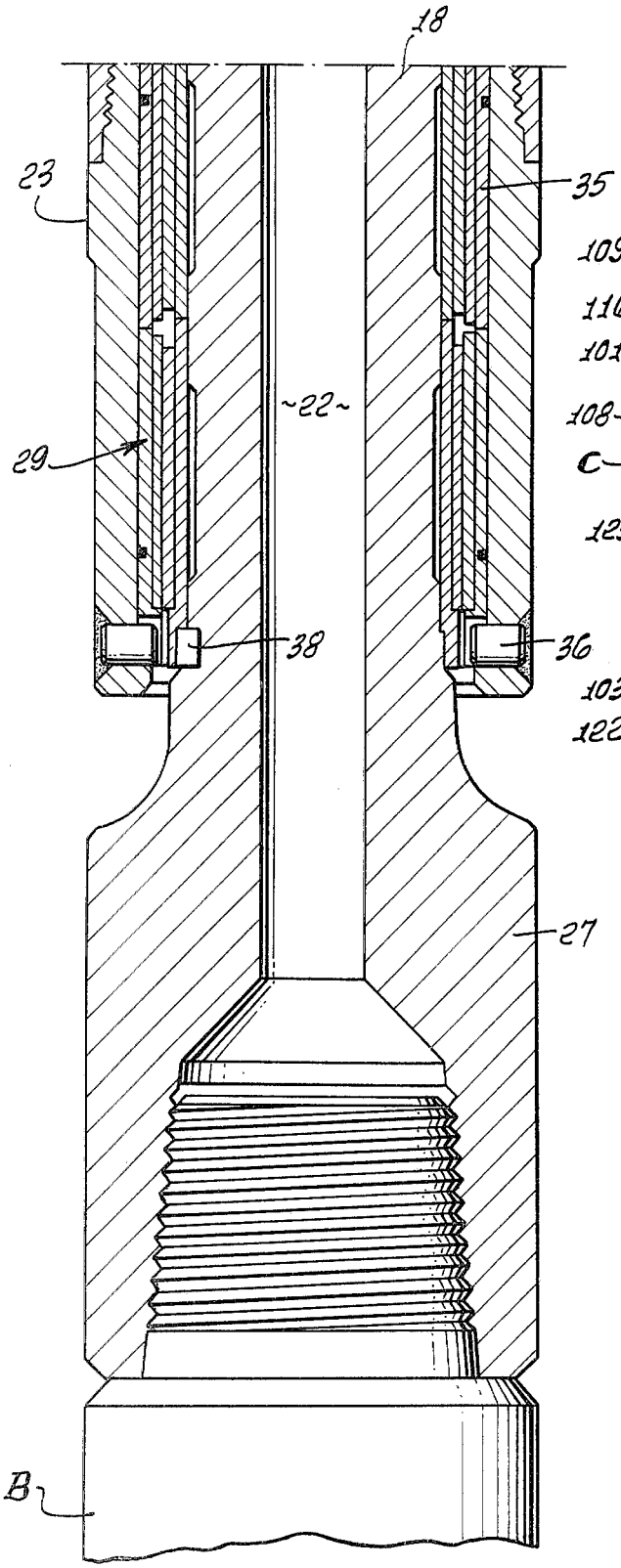
Figure 6:
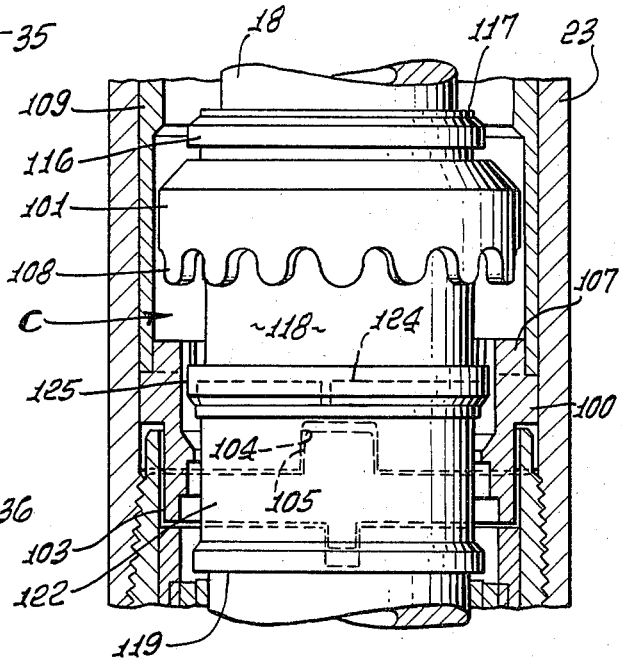
FIG. 6 is a vertical section, partly in elevation, as taken on the line 6—6 of FIG. 2*b*.

During operation of the fluid motor M, the lower end of the rotor 12 has an eccentric motion which is transmitted to the drive shaft 18 by the universal connecting rod assembly 15, and the drive shaft 18 revolves about a fixed axis within the outer housing structure 23 of the bearing assembly 19, the drive shaft being supported within the housing by bearing means 24 and 25 shown in FIGS. 2*a*–2*c*.

The bearing assembly of U.S. Pat. No. 4,029,368 is mud lubricated and a certain amount of the total volume of the circulating fluid is allowed to flow through the bearings, at a rate determined by flow restrictor sleeves, due to the differential pressure caused by the restricted flow of the majority of the circulating or drilling fluid through the bit nozzles, as is well known. The bearing of that patent and all the bearings assemblies of the same general type have set down bearings to transmit axial load from the drill string to the bit, through the drive shaft, and pick-up or off bottom bearings by which the bit is pulled from the hole, when the drill string is pulled.

In the case of the bearings 24 and 25, generally illustrated in FIG. 1, the bearing means 24 is a pick-up bearing, while the bearing means 25 is the set down bearing, as will be well understood and as will be more fully described below.

The invention provides a clutch C between an enlarged lower end 26 of the shaft 18 (see FIGS. 1 and 2*b*) and the lower end of the housing 23 of the bearing assembly 19. In the form shown, the clutch C is normally disengaged, but is adapted to be engaged when an upward pull is applied to the pipe string D tending to raise the drilling assembly in the bore hole.

Referring to FIGS. 2*a* through 2*c*, it will be seen that the elongated tubular shaft is connected at its upper end by a threaded joint 18*a* to a connector cap 18*b* which contains the inlet ports 21 and which connects the upper end of the shaft to the universal joint 17 by a threaded connection. At its lower end, the shaft 18 projects from the housing 23 of the bearing assembly 19, and has an enlarged, lower bit connector 27, to which the threaded pin of the bit B is connected, in the usual manner.

Figure 7:
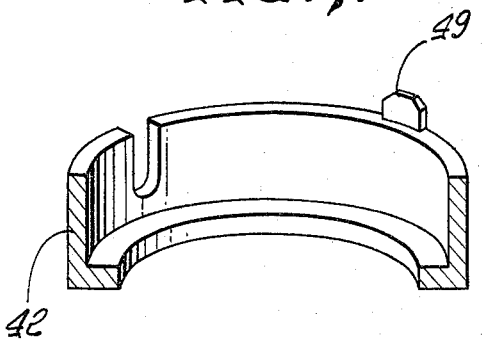
FIG. 7 is a perspective of the pick-up bearing stop sleeve.

The drilling fluid which is circulated by the pump P, downwardly through the pipe string P and through the motor M, as previously indicated, finds access to the passage 22 through the shaft 18, by the ports 21 and a certain limited portion of the drilling fluid is permitted to flow between the housing and the shaft to lubricate the bearings 24 and 25. Alternatively, it will be understood by those skilled in the art that the bearing assembly may be of a sealed construction, such as that disclosed in the above-identified application of Geczy and Tschirky. In the illustrative form, the flow of drilling fluid through the bearings of the bearing assembly is restricted by upper flow restrictor means 28 (FIG. 2*a*) and lower flow restrictor means 29 (FIG. 2*c*) which also constitute radial bearings. Such radial bearings are more particularly disclosed and are the subject of the patent granted to Tschirky and Crase on June 14, 1977, U.S. Pat. No. 4,029,368. The upper flow restrictor means 28 includes an upper flow restrictor sleeve assembly 30 which is pinned to the housing by suitable pins not shown and has internal wear resistant elements 32 therein, which may be constructed in accordance with the above-identified patent. Internally of the flow restrictor sleeve 30 is a flow restrictor sleeve 33 which is locked or keyed to the shaft by locking means 34, for rotation with the shaft. These flow restrictor sleeves limit the amount of drilling fluid which can pass downwardly from the housing above the flow restrictor sleeve into the region of the thrust bearings 24 and 25, later to be described. Correspondingly, the lower flow restrictor means 29 include an outer flow restrictor sleeve 35 which is pinned as at 36, to the housing an an inner flow restrictor sleeve 33, which is connected or keyed as at 38 to the shaft for rotation therewith. This lower flow restrictor means may also be constructed in accordance with the above-identified patent and is adapted to constitute a lower radial bearing. The thrust bearings 24, as seen in FIGS. 2*a* and 2*b*, are adapted to transmit drilling thrust or load from the drill string D, through the housing structure of the bearing assembly to the shaft 18, to impose weight upon the bit, during drilling, as drilling fluid is pumped downwardly through the running string D and the motor M to rotate the shaft within the housing. Thus, as seen in FIG. 2*a*, the housing structure includes a downwardly facing shoulder 39, provided at the lower end of the threaded pin of a flow restrictor sub 40, which engages an annular spring seat and thrust member 41 suitably keyed to the housing by interfitting lugs 41*a*, so as to be non-rotatably mounted in the housing 41. As seen in FIG. 2*b*, there is a lower thrust member 42, which in a manner to be later described in connection with the clutch C, is in thrust transfer relationship with the housing, to transmit thrust upwardly to the shaft upon elevation of the housing. As seen in FIG. 7, to best advantage, the thrust member 42 has lugs 42*a* and notches 42*b*, which provide for a "lug connection" with an upper thrust member later to be described.

The specific structure of the bearings 24 and 25 between the thrust member 41 of FIG. 2*a* and the thrust member 42 of FIG. 2*b* is not germane to the present invention and various well known bearing structures may be utilized to provide for the application of drilling weight to the bit and for the application of an upward pull on the shaft to elevate the bit off bottom or attempt to remove the stuck bit. Such bearing assemblies may be of the sealed type as disclosed in the above-identified application, Ser. No. 818,423 or of the type disclosed in prior U.S. Pat. No. 3,936,247 of Tsckirky and Crase.

The bearing structure as specifically shown herein, however, is an advantageous bearing structure which is the subject matter of an application Ser. No. 067,923. As shown, the bearing assembly includes between the opposing thrust members 41 and 42 two sets of bearings 24 and 25, in tandem, adapted upon opposite loading of the housing in an axial direction, to transmit thrust to a pair of thrust collars 43 mounted on the shaft, as seen in FIGS. 2*a* and 2*b*. These thrust collars 43 are split rings, secured about the shaft by fastener screws 44, with an internal flange 45 disposed in a groove 46 in the shaft, the flange and groove being eccentric with respect to the shaft, to secure the collar on the shaft against relative rotation, Each bearing set includes a spacer sleeve 47, the upper spacer sleeve 47 having a drive lug connection 48 with the thrust member 41, and the lower spacer sleeve 47 having a drive lug connection 49 with the thrust member 42. The upper spacer sleeve 47 spans the upper thrust collar 45 and has a drive lug connection 50 with an intermediate thrust transfer member 51 which also has a drive lug connection 52 with the lower thrust sleeve or spacer sleever 47.

Referring to FIG. 2*a*, it is seen that the thrust member 41 has a lug connection 53 with an intermediate thrust member 54 providing an upwardly facing shoulder 55 opposed by the undersurface 56 of the thrust member 41, between which is disposed a stack of Belville springs 57. The lug connection 53 between the thrust member 41 and the thrust member 54 is constructed to afford a certain amount of relative axial movement as indicated at the gap 58, whereby the springs 57 can be selected to apply a certain amount of axial loading downwardly from the downwardly facing shoulder 56 to the thrust member 54, to the upper thrust transmitting spacer 47, the thrust member 51, the lower spacer 47 and to the lower thrust member 42 in a manner in which all of the bearings 24 and 25 are maintained under a spring load, during operation of the motor drill, both during the drilling of the bore hole, and when the bit is off bottom and fluid is being circulated.

As previously indicated, the sets of bearings are in tandem and each acts upon one of the thrust collars 43. As seen in FIG. 2*b*, the bearing 25 will be seen to include a lower race 60 pinned as at 61 to the lower thrust member 42 for mutual rotation and relative longitudinal movement. Belleville springs 62 are engaged between the thrust member 42 and the race 60 to provide for shock absorption, the springs 62 having a strength greater than the strength of the springs 57. An upper race 63 is secured to the shaft, for rotation therewith by a suitable number of lugs 64 which engage in circumferentially spaced notches 65 provided in the thrust collar 43. Since the collar 43 is locked on the shaft, the lugs 64 lock the race 63 on the shaft for mutual rotation. Bearing balls 66 are disposed in raceways in the respective bearing races 60 and 63.

Above the thrust collar 43 of FIG. 2*b*, the set down bearing 24 has a lower race 67 secured to the shaft for unitary rotation by a suitable number of lugs 68 which extend into notches 68*a* in the thrust collar 43. Since the thrust collar 43 is secured to the shaft, the bearing race 67 is correspondingly, by the lugs 68, connected to the shaft for mutual rotation. An upper bearing race 69 is connected by a number of pins 70 to the intermediate thrust member 51 for mutual rotation and relative longitudinal movement, and bearing balls 71 are disposed in raceways in respective races 67 and 69. The bearing 24 is cushioned against shock, during drilling operations, by Belleville springs 72 disposed between the thrust member 51 and the upper race 69, the springs 72 also being stronger than the preloading springs 57 at the upper end of the bearing assembly.

The pick-up bearing 25, at the upper end of FIG. 2*b*, and the set down bearing 24 at the lower end of FIG. 2*a*, constitute a bearing assembly which is the same as that just described, and thrust is transmitted in either direction to the upper thrust collar 43, in the same manner described with respect to the lower bearings. Therefore no further description of the bearing assembly is believed necessary to an understanding of the present invention.

The present invention is more particularly concerned with the clutch means C which is disposed between the lower thrust member 42 of the bearing structure just described and an upwardly facing thrust shoulder 75 provided adjacent the upper end of the pin 76 forming part of the threaded connection 77 and seen at the lower end of FIG. 2*b*.

Figure 3A:
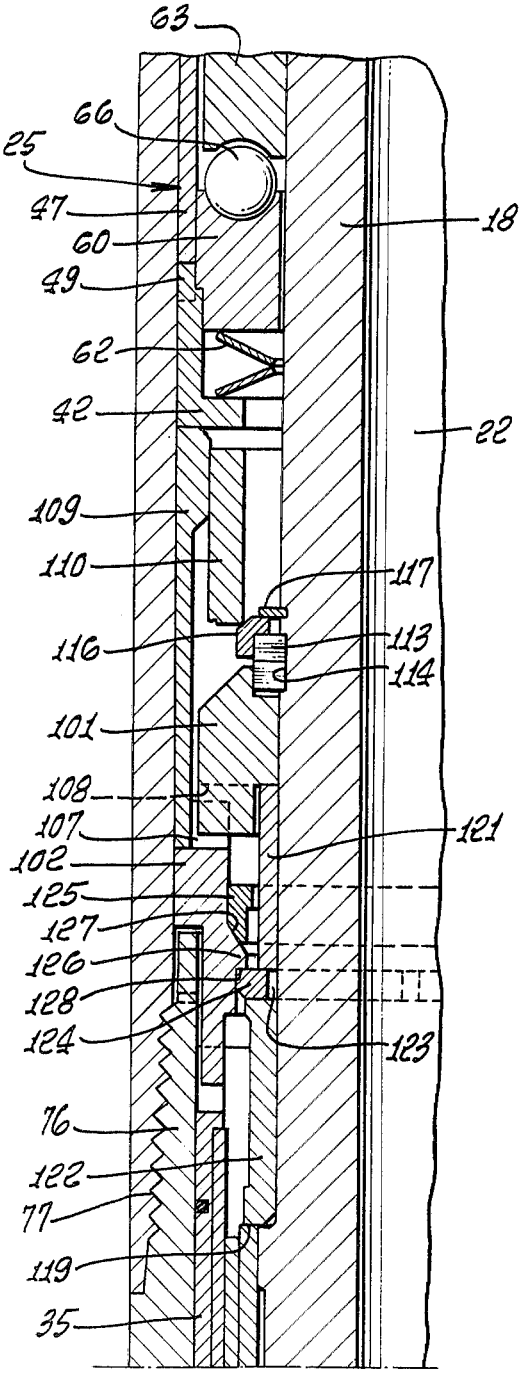
FIGS. 3*a* and 3*b*, together constitute a view corresponding to FIGS. 2*b* and 2*c*, on an enlarged scale, but showing the clutch engaged.
Figure 3B:
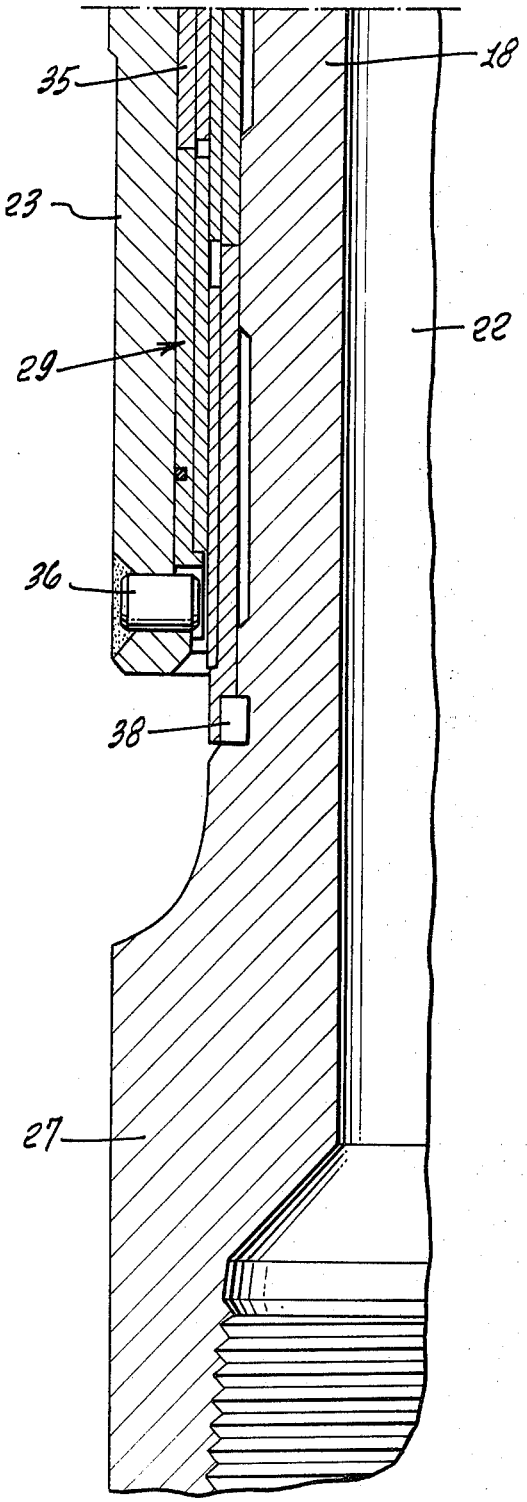

The clutch C is shown in a normally disengaged condition in FIG. 2*b* and is shown in an engaged condition in FIG. 3*a*. In the normally disengaged condition of FIG. 2*b*, the in-hole motor apparatus is operable in the conventional manner. This is to say that the motor drill apparatus can be lowered into a well bore which is being drilled into or through the earth formation, and drilling fluid circulated downwardly through the running pipe string P to drive the motor M to cause rotation of the drive shaft 18 exits through the drill bit and flows upwardly through the bore hole, externally of the running pipe string to the top of the well bore. Drilling weight is applied to the bit B through the application of weight downwardly against the shaft, from the drill pipe string, through the set down or drilling bearings 24, previously described. When the motor drill apparatus is to be elevated in the well bore, either for retrieval, or for circulation off bottom, and if the bit is not stuck, the drive shaft 18 is lifted upon upward movement of the housing by the pick-up bearings 25. The thrust necessary to raise the drive shaft along with the housing is transmitted to the pick-up bearings 25 from the shoulder 75 in the housing, through the clutch means C to the thrust transmitting members and spacers described above, to the respective thrust collars 43.

In the event that the bit B is stuck in the well bore, and therefore the drive shaft is not, under ordinary tensile load, capable of being moved upwardly along with the housing, under the influence of the forces applied through the pick-up bearings, the clutch is constructed to become engaged. Since the engagement of the clutch is responsive to the application of a longitudinal upward force on the housing, in excess of that normally necessary to elevate the drive shaft along with the housing, the clutch is engageable without adding weight to the bit, as is desirable in the case that the bit is in a gummy formation.

More particularly, the clutch C comprises a pair of coengageable torque transmitting members 100 and 101, the clutch member 100 being carried by the housing and the clutch member 101 being carried by the shaft, as will be later described, in such a manner that, when the clutch members are coengaged torque can be transmitted from the housing to the shaft, and in addition, upward pull can be applied to the shaft from the housing, in an effort to retrieve the bit. Clutch member 100 is of annular form and has a body 102 provided with a lower skirt section 103 extending downwardly within the housing pin section 76. The body 102 has a suitable number of circumferentially spaced notches or recesses 104 adapted to receive upwardly projecting lugs 105 on the pin section 76, whereby the clutch member 102 is locked to the housing for mutual rotation. As previously indicated, the shoulder 75 of the housing pin member 76 is engageable beneath the body section 102 of the clutch ring 100.

On its upper end, the clutch member 100 has an upwardly facing thrust shoulder 106 and a number of circumferentially spaced upwardly facing clutch drive lugs or teeth 107 adapted for interfitting and torque transmitting relationship with downwardly facing lugs or teeth 108 on the companion clutch member 101. A thrust transmitting member 109 is disposed between the clutch member 100 and the lower bearing thrust member 42, normally maintaining the spaced interval between these two components, with the clutch normally disengaged. This thrust transmitting member 109 is shown as a sleeve which abuts at its lower end with the thrust shoulder 106 of the clutch member 102 and at its upper end with the undersurface of the bearing thrust member 42. Specifically, the sleeve or thrust member 109 acts as a yieldable thrust transmitting connection between the housing and shaft and is shown as having an upper section 110, the outside diameter of which is adapted to allow upward movement of the lower section of the sleeve 109, when a frangible or shearable section 111 is, under a force in excess of that normally required to elevate the shaft in response to elevation of the housing, caused to be sheared or fractured. Other frangible or shearable structures are clearly contemplated by the invention, such as telescopic sleeves interconnected by frangible pins or shearable members, and other deformable thrust transmitting means may be employed in lieu of the shearable sleeve 109.

The upper clutch member 101 is in the form of an annular body 112 disposed about and secured to the shaft for rotation therewith as by means of eccentric lock rings 113 disposed in an eccentric groove 114 in the outer periphery of the shaft, these split lock rings being retained in assembly by being recessed in a groove 115 in the upper end of the clutch body member 112 and by a retainer ring 116 which is disposed about the upper lock ring and held in place with respect thereto by a suitable retainer or snap ring 117.

The clutch body member 112 is held in an upper position on the shaft 18 by a spacer assembly 118 which shoulders at its lower end on the shaft, as at 119, and shoulders at 120 beneath the clutch body member 112. This spacer structure 118 also serves another function which will be hereinafter described, to lock the clutch in engagement.

The previously referred to, spacer structure 118 includes an upper spacer sleeve 121 and a lower spacer sleeve 122 between which there is a radial groove 123 having a split resilient ring 124 therein, the ring 124 being normally resiliently expansible outwardly with respect to the groove 123, but being retained in a resiliently inwardly deformed condition by a retainer ring 125. Ring 125 is disposed about the upper spacer sleeve 121 and has a skirt slidably disposed about the outer periphery of the contracted spring ring 124. The body 102 of the clutch member 100 has an inwardly extended annular flange having an upwardly facing inclined shoulder 127 and a downwardly facing horizontal shoulder 128. The inner periphery of the said annular flange is adapted to pass upwardly over the outer periphery of the circumferentially inwardly deformed lock ring 124 and to hold the lock ring deformed inwardly, as the upwardly facing shoulder 127 brushes or slides the retainer ring 125 upwardly from the lock ring 124, during the engagement of the clutch. Thus, the spring retainer ring 125 is a means for releasably holding the lock ring 124 compressed, releasable in response to engagement of the clutch to allow circumferential outward expansion of the resilient ring 124 to a position, as seen in FIG. 3*a*, wherein the lock ring 124 is engaged beneath the shoulder 128, preventing release of the clutch.

With the clutch engaged, continued circulation of drilling fluid can be accomplished by opening the circulation valve above the motor, thereby diverting fluid to the annulus, during rotation of the running string and the bit, to flush the bore hole. If upward pull by the lines L cannot release the bit, a jar can be actuated to apply additional upward impact force to the clutch, tending to pull the bit free.

We claim:

1. An in-hole motor assembly adapted for connection with a rotatable pipe string and a bit, said assembly comprising: a motor stator including a housing structure connectable at one end to a pipe string; a rotor in said stator connected at one end to a shaft for rotation therewith and extending at the other end of said shaft from said housing for connection to a drill bit; thrust bearing between said shaft and said housing structure to transmit thrust from said housing to said shaft; a clutch engageable between said shaft and said housing to couple said housing structure and shaft for mutual rotation and a lock holding said clutch against disengagement on application of thrust between said housing and said shaft.

2. An in-hole motor as defined in claim 1, including a lock for holding said clutch engaged, said lock comprising a resiliently expansible ring carried by said shaft, a retainer removably disposed in said ring to prevent expansion of said ring, said clutch including a clutch member carried by said housing structure and a clutch member carried by said shaft, said clutch member carried by said housing structure having a portion engageable with said retainer to remove said retainer upon longitudinal movement of said housing structure relative to said shaft in a direction to engage said clutch, and a shoulder on said clutch member carried by said housing structure engageable with said ring upon removal of said retainer to prevent reverse longitudinal movement of said housing structure relative to said shaft.

3. An in-hole motor as defined in claim 1; releasable thrust transmitting connection between said housing structure and the thrust bearings disconnectable upon the application of a predetermined thrust load on said shaft in the direction of said one end, said thrust bearing including springs for cushioning opposite relative longitudinal movement of said housing structure and said shaft, and thrust transfer means engageable to transmit thrust from said releasable thrust transmitting connection to said shaft.

4. An in-hole motor adapted for connection with a rotatable pipe string and a bit, said assembly comprising: a motor stator including a housing structure connectable at one end to a pipe string; a rotor in said stator connected at one end to said rotor for rotation therewith and extending at its other end from the other end of said housing structure to drive a drill bit thrust bearings between said shaft and said housing structure to transmit thrust from said housing to said shaft in the direction of said other end and to transmit thrust from said housing structure to said shaft in the direction of said one end; yieldable thrust transmitting connection between said housing structure and shaft, said yieldable thrust transmitting connection including a frangible section, shearable on application of sufficient thrust; a clutch engageable between said shaft and said housing structure to couple said housing structure and shaft for mutual rotation upon movement of said housing relative to said shaft in the direction of said one end; including a lock for holding said clutch engaged.

5. An in-hole motor as defined in claim 4; said lock being automatically engageable upon engagement of said clutch.

6. An in-hole motor as defined in claim 4; said clutch including a clutch member rotatable with said shaft and in thrust transmitting relation with said shaft towards said one end; a clutch member in said housing structure rotatable therewith and in thrust transmitting relation with said shaft towards said other end; said clutch members having opposing thrust transmitting portions engageable upon engagement of said clutch to transmit thrust from said housing structure to said shaft towards said one end.

7. An in-hole motor as defined in claim 4; said lock comprising a spring ring carried by one of said shaft and said clutch and resiliently shiftable circumferentially, and a groove in the other of said shaft and said clutch to receive a periphery of said ring when said clutch is engaged.

8. An in-hole motor as defined in claim 4; releasable thrust transmitting connection between said housing structure and the thrust bearings disconnectable upon the application of a predetermined thrust load on said shaft in the direction of said one end, said thrust bearing including springs for cushioning opposite relative longitudinal movement of said housing structure and said shaft, and thrust transfer means engageable to transmit thrust from said releasable thrust transmitting connection to said shaft.

9. The method of connecting a housing to a shaft of fluid driven motor drill apparatus in a bore hole, comprising: running a fluid driven motor drill having a housing and a rotary shaft into a bore hole with the housing connected at one end to a fluid conducting running pipe, and the shaft extending from the housing and having a drill bit thereon, driving the motor drill while applying drilling force to said motor drill by circulating fluid through said running pipe and said housing connecting said bit to said running pipe for mutual rotation without increasing said drilling weight by applying an upward pull on said running string when said bit is stuck against upward movement to release a releasable thrust transmitting connection between said housing and said shaft.

10. The method of claim 9, including locking said housing and said shaft together, relaxing said upward pull, and rotating said drill string.

11. An in-hole motor assembly adapted for connection with a rotatable pipe string and a bit, an assembly comprising a motor stator including a housing connectable to one end of a pipe string; a rotor in said stator, a shaft connected at one end of said shaft for rotation with said rotor, said shaft extending at the other end of said shaft from said housing for connection to a drill bit, thrust bearing between said housing and said shaft; a clutch engageable between said shaft and housing for mutual rotation on movement of said housing relative to said shaft; a yieldable thrust transmitting connection between said housing and shaft limiting the relative longitudinal movement of said shaft and housing on application of a limitied thrust and yielding to permit of a further longitudinal movement on application of additional thrust to engage the clutch; and a lock holding said clutch against disengagement on application of a thrust between said housing and said shaft.

12. An in-hole motor as defined in claim 1 or 11; said lock including means automatically engageable upon engagement of said clutch.

13. An in-hole motor as defined in claim 1 or 11; said clutch including a clutch member rotatable with said shaft and in thrust transmitting relation with said shaft towards said one end; a clutch member in said housing structure rotatable therewith and in thrust transmitting relation with said shaft towards said other end; said clutch members having opposing thrust transmitting portions engageable upon engagement of said clutch to transmit thrust from said housing to said shaft towards said one end.

14. An in-hole motor as defined in claim 7 or 11 including a lock automatically engageable upon engagement of said clutch members enabling thrust transmission from said housing structure to said shaft towards said other end.

15. An in-hole motor as defined in claim 1 or 11; said lock comprising a spring ring carried by one of said shaft and said clutch and resiliently shiftable circumferentially, and a groove in the other of said shaft and said clutch to receive a periphery of said ring when said clutch is engaged.

16. An in-hole motor as defined in claim 11; releasable thrust transmitting connection between said housing structure and the thrust bearings disconnectable upon the application of a predetermined thrust load on said shaft in the direction of said one end, said thrust bearing including springs for cushioning opposite relative longitudinal movement of said housing structure and said shaft, and thrust transfer means engageable to transmit thrust from said releasable thrust transmitting connection to said shaft.

* * * * *